US005570848A

United States Patent [19]

Gock et al.

[11] Patent Number: 5,570,848

[45] Date of Patent: Nov. 5, 1996

[54] ECCENTRIC VIBRATING MILL

[75] Inventors: Eberhard Gock, Goslar; Willbrord Beenken, Kerken–Niewkerk; Miroslaw Gruschka, Oberhausen, all of Germany

[73] Assignee: Siebtechnik GmbH, Germany

[21] Appl. No.: 325,837

[22] Filed: Oct. 19, 1994

[30] Foreign Application Priority Data

Oct. 20, 1993 [DE] Germany ..... 43 35 797.0

[51] Int. Cl.[6] ..... B02C 17/14

[52] U.S. Cl. ..... 241/172; 241/175

[58] Field of Search ..... 241/175, 172, 241/174

[56] References Cited

U.S. PATENT DOCUMENTS

| | | | |
|---|---|---|---|
| 2,970,781 | 2/1961 | Morris | 241/175 |
| 3,018,059 | 1/1962 | Lodige et al. | 241/174 X |
| 3,310,245 | 3/1967 | Decker et al. | 241/175 X |
| 3,391,872 | 7/1968 | Cooley | 241/176 |
| 3,425,670 | 2/1969 | Shaw . | |
| 3,539,117 | 11/1970 | Sjogren | 241/172 |
| 3,545,688 | 12/1970 | Oshima et al. | 241/175 X |

FOREIGN PATENT DOCUMENTS

| | | | |
|---|---|---|---|
| 2255964 | 7/1975 | France | 241/175 |
| 3404942 | 8/1985 | Germany . | |
| 4242654 | 6/1994 | Germany . | |
| 1127631 | 12/1984 | U.S.S.R. | 241/175 |

OTHER PUBLICATIONS

"Analysis of Tube Vibrating Mills," by K. Kurrer et al., Continuing Reports VDI, Processing Technology Series No. 282, VDI Verlag (1992).

*Primary Examiner*—John M. Husar

*Attorney, Agent, or Firm*—Reed Smith Shaw & McClay

[57] ABSTRACT

An eccentric vibrating mill with at least one grinding container, to which is solidly attached the exciter unit as vibrating drive, and in which for the purposes of improving the grinding properties of conventional vibrating mills according to the present invention there is provision for the grinding container to be excited eccentrically on one side, that is, outside the gravity axis and the mass center of the grinding container, whereby a balancing mass is provided for balancing the eccentric mass and the drive side spring axis lies between the gravity axes of the grinding container and the exciter unit and the exciter unit is operated such that uneven vibrations such as circular, elliptical and linear vibrations are produced.

19 Claims, 5 Drawing Sheets

ECCENTRIC VIBRATING MILL

BACKGROUND OF THE INVENTION

1. Field of the Invention

The present invention relates to an eccentric vibrating mill having at least one grinding container to which as exciter unit is solidly attached and which serves as a vibrating drive.

2. Description of the Related Art

As is known, vibrating mills comprise cylindrical, trough-shaped or hopper-shaded containers, freely swivel-mounted on rubber buffers or springs, which are displaced into substantially circular swinging movements either by means of one exciter revolving in the mass centre, or by means of several exciters in the form of flyweights aligned on the mass centre. Impacts, which penetrate inside the grinding element filling by impulse propagation, are sent to the grinding elements housed in the grinding containers. Crushing is carried out by impact and friction action between the grinding elements themselves and between the grinding elements and the container wall. The mill filling describes a circular movement against the work direction of the exciter, ensuring conveyance of the grinding material.

In all contemporary vibrating mill designs—finishing programs of the companies: KHD Humbold Wedag AG, Cologne; Aulmann und Beckschulte, Maschincnfabrik Bergneustadt; Siebtechnik GmbH Maschincn-und Apparatebau, Müllheim/Ruhr; IBAG, Neustadt/Weinstraβe; Ratzinger GmbH, Munich—the eccentric exciter is located in the mass centre of the machines so that the process can start with a circular vibration.

Suggestions for the construction of vibrating mills are known from the patent literature, in which the eccentric exciter or exciters is/are arranged outside the mass centre for structural reasons, but which in any case endeavour to describe a circular swinging movement. U.S. Pat. No. 3,545,688 describes a single-valve vibrating mill in which the grinding tube is set in circular vibration on both sides by two horizontally disposed eccentric motors. The object of DE Pat. No. 34 04 942 A1 is a 'grinding device for crushing of coarse material'. The following explanation is given: 'During operation the grinding device according to the present invention is set in circular vibration by means of the eccentric exciters attached to the housing . . . '.

A similar construction principle is the object of U.S. Pat. No. 3,425,670. The grinding container is here additionally compelled by horizontal support springs located on either side, enabling only vertical, elliptical vibrations, which tend to place a strain on the grinding material in the sense of a pounding effect. As already applies to DE No. 34 04 942, the drive is located in the gravity axis. U.S. Pat. No. 3,391,872 describes as a 'Vibrating Grinding Mill' another device in which two eccentric exciters revolving against each other are arranged both outside and inside the gravity axis of the grinding apparatus. The focus here is on the principle of the 'dive' mill (ball mill), in which, for the purpose of improving the grinding effect, the usual rotation of the grinding container is overlaid around the horizontal axis by linear vibrations, caused by both eccentric exciters revolving against one another. The direction of rotation of the grinding element filling is actuated by rotation of the grinding container and this may occur either freely (as a result of the directed linear vibrations) or forced (by means of an additional rotational drive), and not by means of the centrifugal acceleration of the flyweights in standard vibrating mills.

The unpublished DE Pat. No. 42 42 654 A1 describes a process for wet fine grinding and dry fine grinding using a linear trough vibrating mill which comprises two superposed grinding containers mounted on vibrating support elements, in which two exciter units are arranged eccentrically on one side outside the gravity axis and the mass centre of both grinding containers, as in FIGS. 1 and 2. Exciter unit and grinding container are located between the spring axes on the drive side and opposite the drive.

The abovementioned suggestions could not be carried into effect, since, compared to industrially used vibrating mills, they offer no advantage with respect to throughput and specific energy requirement.

A 1992 monograph: Kurrer, K.-E. et al.: 'Analyse von Rohrschwingungmühlen' [Analysis of tube vibrating mills], Continuing Reports VDI, Processing Technology Series No. 282, VDI Verlag 1992, presents research on directions of movement of mill filling and machine dynamics. According to this the grinding space of tube vibrating mills is divided into energy-rich and energy-depleted zones (p. 15 ff.). The energy-richest zone, the main stress zone, is characterised by the strongest normal impact and friction impact force (p. 57 ff.). The friction impact force is the prerequisite for the circular movement of the mill filling. The circular movement of the mill filling runs opposite to the direction of rotation of the exciter. In the case of the normal circular vibration of vibrating mills the mill filling can rotate either in a clockwise or an anticlockwise direction, according to the direction of rotation of the exciter.

SUMMARY OF THE INVENTION

The object of the present invention is to use structural measures to increase the introduction of energy in vibrating mills, so that the size of the energy-depleted zone can be minimised and the upper limit of the grinding container diameter—hitherto determined by the size of the energy-depleted zone—or of the grinding tube diameter of 650 mm can be exceeded.

This occurs according to the present invention in accordance with the principle of the characterising section of claim 1.

Through this arrangement the directions of movement of the mill filling are decisively altered. The extent of the linear vibrations causes an increase in the speed of circulation of the mill filling compared to circular motion vibrating mills by approximately a factor of 4, so that apart from the increase in normal impact force, an increase in the frictional impact force is especially obvious.

Characteristic for the essentially one-sided excitement outside the gravity axis and the mass centre of the vibrating mill is that by comparison with the normal circular vibrating mills the circular movement of the mill filling happens only when the exciter is arranged on the left side and is driven in an anticlockwise rotation, and when it is arranged on the right side and is driven in a clockwise rotation.

The advantage of the one-sided excitement of the vibrating mill outside the gravity axis and of the mass centre is that the additional incidence of elliptical and linear vibrations contributes essentially to the improvement of the transport procedures by an increase in the speed of rotation, which is critical for the continuance of grinding.

BRIEF DESCRIPTION OF THE DRAWINGS

The invention will now be explained in greater detail hereinbelow with reference to the diagrams.

DESCRIPTION OF PRESENTLY PREFERRED EMBODIMENT(S)

Figure 1:
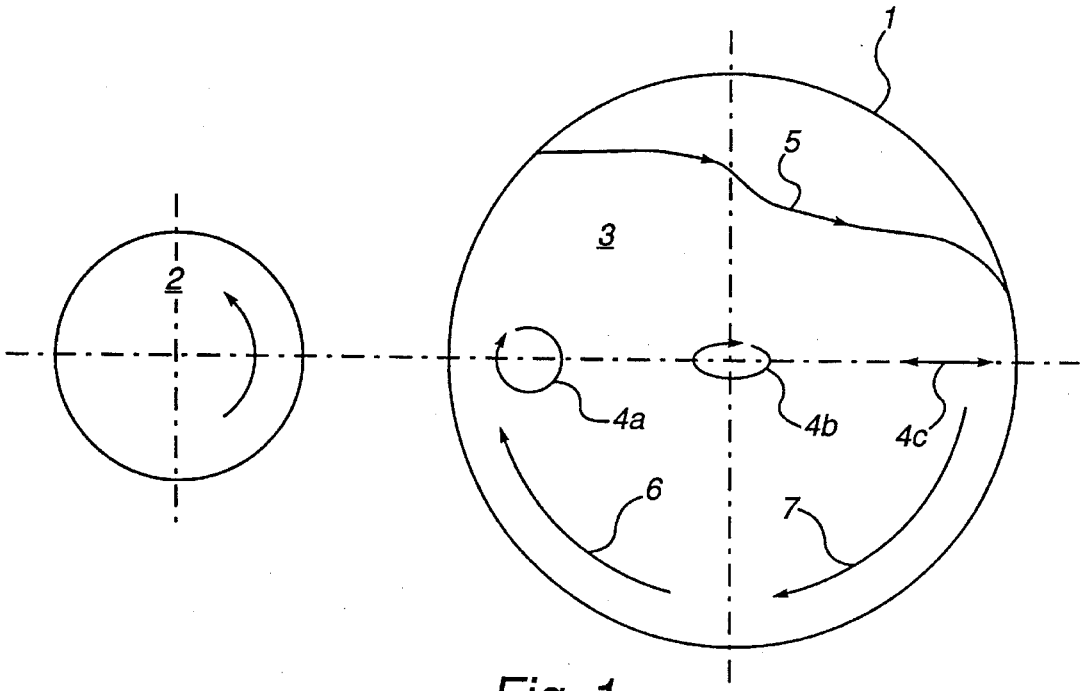
FIGS. 1 and 2 schematically represent the operation of the vibrating mill according to the present invention.

The operation of the object of the invention will be explained with reference to the diagrams illustrated in FIGS. 1 and 2. In FIG. 1 a grinding tube (1) mounted on vibrating support elements (not illustrated) is set in vibration by an exciter (2) turning to the left and arranged on the left side outside the gravity axis. As a result of the one-sided excitement the grinding tube describes only circular vibrations on the side of the exciter (arrow 4*a*), which by means of elliptical vibrations (arrow 4*b*) transform in the centre into linear vibrations (arrow 4*c*) on the side of the grinding tube opposite exciter (2).

With an exciter (2) rotating to the left the mill filling designated by reference numeral (3) is set in rotation to the right (arrow 5). At the same time on the exciter side the mill filling describes an upwards movement (arrow 6), and a downwards movement (arrow 7) on the side opposite the exciter. Whereas circular vibration (4*a*) determines circular direction (6) of mill filling (3) on the exciter side, added acceleration is imparted thereto by linear vibrations (4*c*) on the side opposite exciter (2), such that the speed of rotation is greater by approximately a factor of 4 than in conventional circular vibrating mills. The distance from the axis of the exciter parallel to the axis of the grinding container should be greater than the smallest distance from the grinding container centre to the grinding container inner wall.

Figure 2:
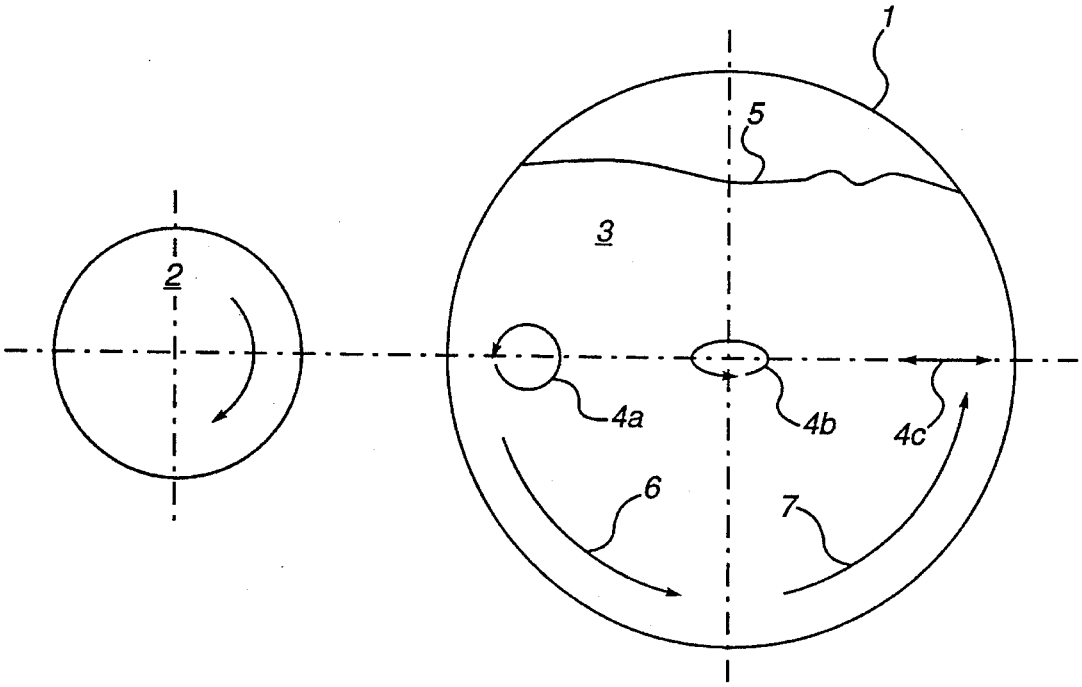

FIG. 2 shows the movement ratios when exciter (2), arranged to the left on one side outside the gravity axis and of the mass centre, is driven in a clockwise direction. Under these conditions there is no circular movement (5) of mill filling (3), since upwards movement (6) of mill filling (3) occurs in the vicinity of linear vibration (4*c*). In this case the stress of the grinding material occurs only by impact. By way of comparison, in conventional circular vibrating mills the mill filling always rotates towards the working direction, irrespectively of whether the exciter is being driven in a clockwise or anticlockwise direction.

Compared to conventional vibrating mills, there are the following advantages:

increase in the disintegration grade of the mill filling, such that the previous maximum charging granulation can be raised by a factor of at least 2, improvement in transport procedures through high rotational speeds of the mill filling and homogenisation of the grinding material distribution by abolishing separation, increase in the specific throughput, reduction in energy requirements, dispensing with the energetically determined upper limit of the grinding tube diameter, previously at 650 mm, reduction in downtime for repairs by omission of transmission components such as shafts, couplings and the like, enabling of the modular construction by coupling of components having identical grinding tube diameter to mills of varying length for various crushing tasks and durations.

Four embodiments of the present invention for eccentric vibrating mills having a grinding tube diameter of 600 to 1000 mm are described diagrammatically.

Figure 3:
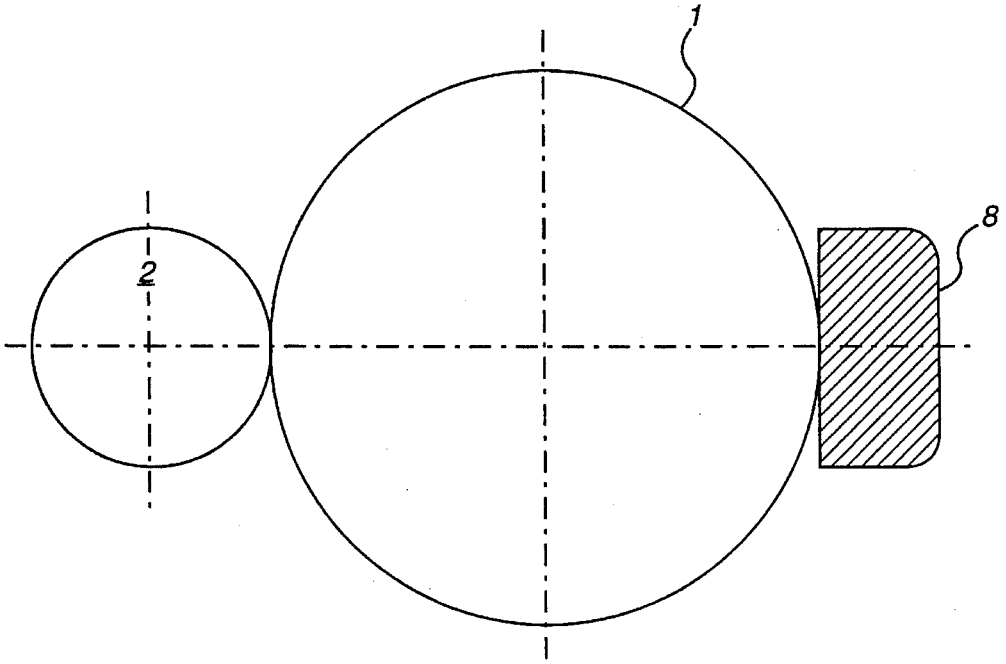
FIGS. 3 to 6 schematically represent various embodiments of the vibrating mill according to the present invention.

FIG. 3 schematically represents the design of an eccentric vibrating mill with a vibrating grinding container in the form of a grinding tube (1) of 600 mm in diameter which on one side outside the gravity axis and the mass centre is rigidly connected to an eccentric motor as exciter (2). The exciter mass is balanced by a parallel balancing mass (8) disposed on the opposite side of the grinding tube.

Figure 4:
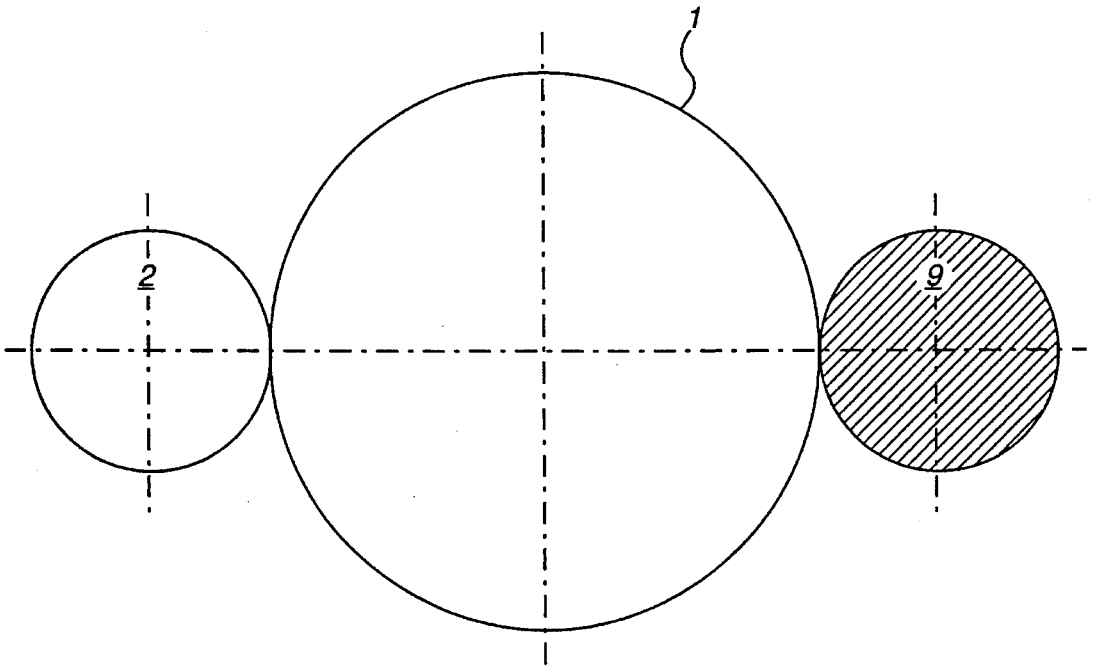

In accordance with FIG. 4 the same construction as in FIG. 3 is developed by a second eccentric motor (9) being located directly on grinding tube (1), instead of balancing mass (8). The vibrating mill can be operated selectively either by exciter (2) or by exciter (9), whereby the other eccentric motor (9 or 2) functions as a balancing mass. This allows operation of the mill with various exciter parameters such as rotational speed and vibration diameter.

Figure 5:
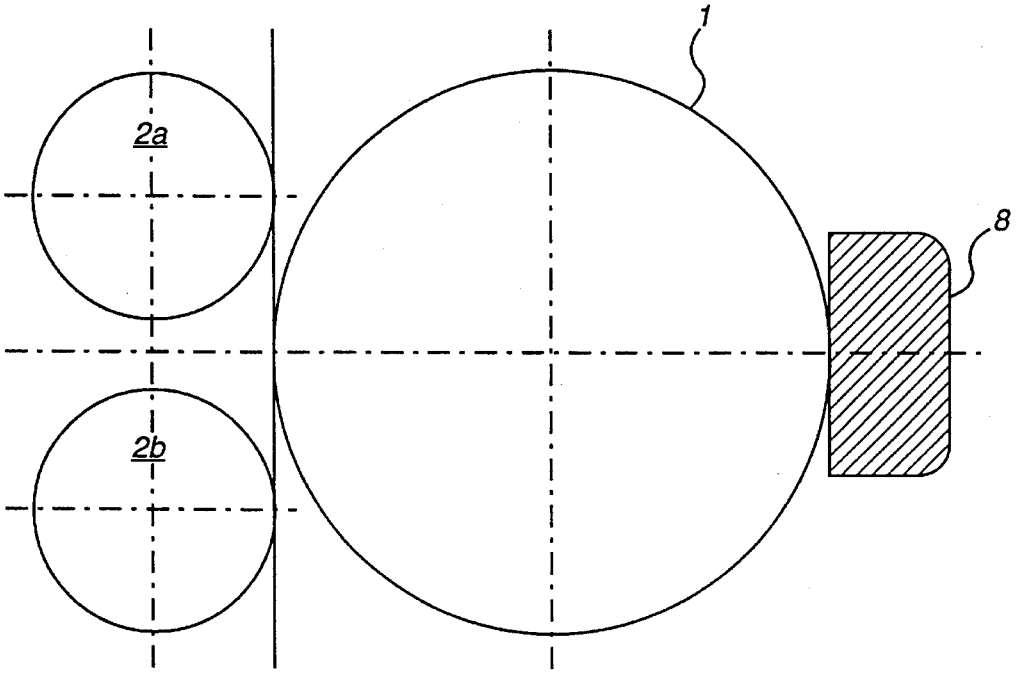

A further example of the invention is illustrated in FIG. 5. In this case grinding tube (1) has a diameter of 1000 mm and is fitted with two synchronously operating eccentric motors as exciter (2*a*, 2*b*), arranged on one side outside the gravity axis and mass centre. The exciter mass is again balanced by a balancing mass (8), as in FIG. 3.

Figure 6:
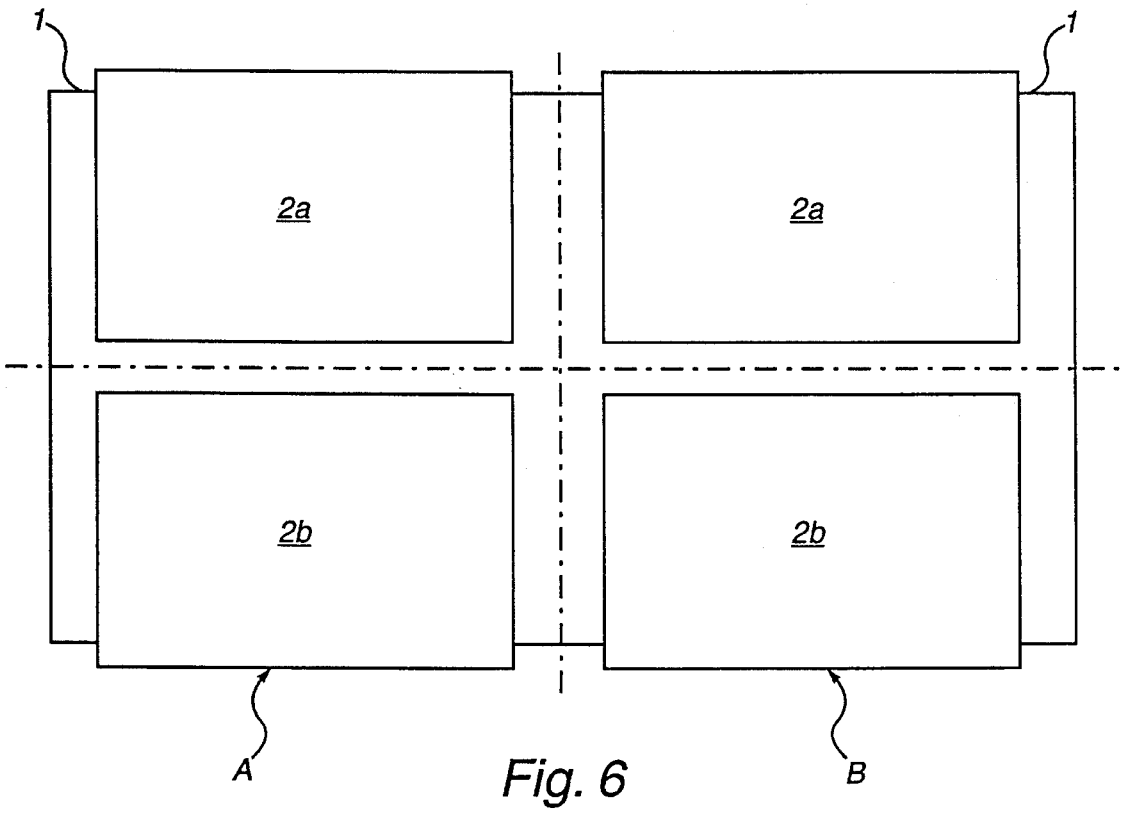

The coupling of components according to FIG. 5 is illustrated in FIG. 6. Two components (A) and (B) are added to a mill to accommodate different grinding tasks.

Figure 7:
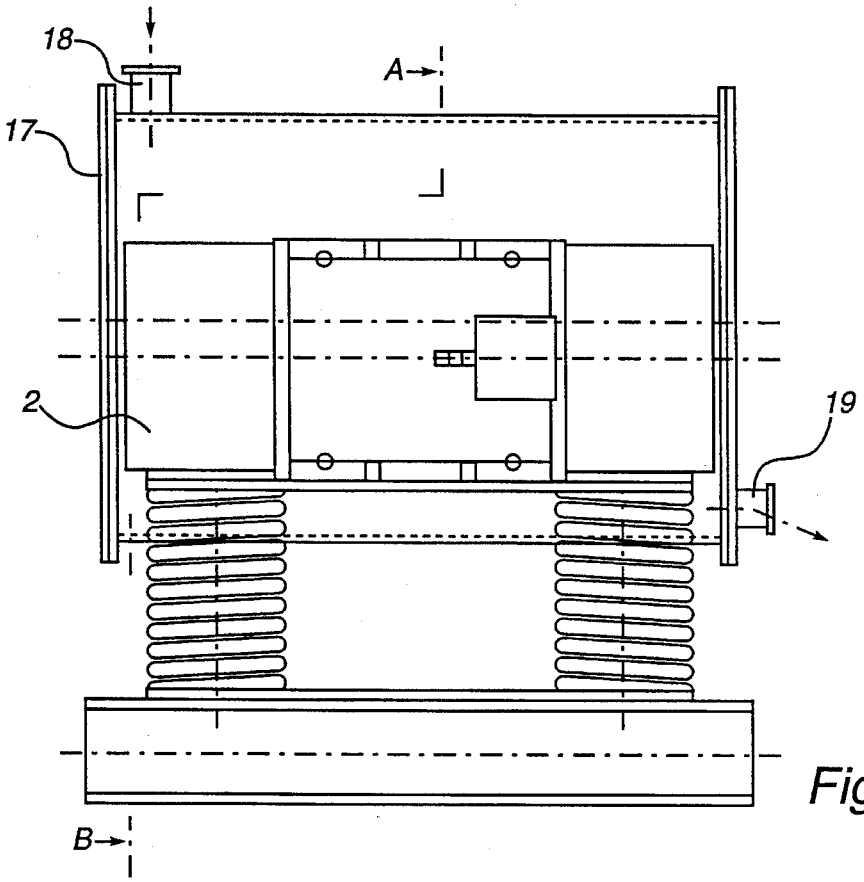
FIG. 7 shows a side view of the vibrating mill according to the present invention.
Figure 8:
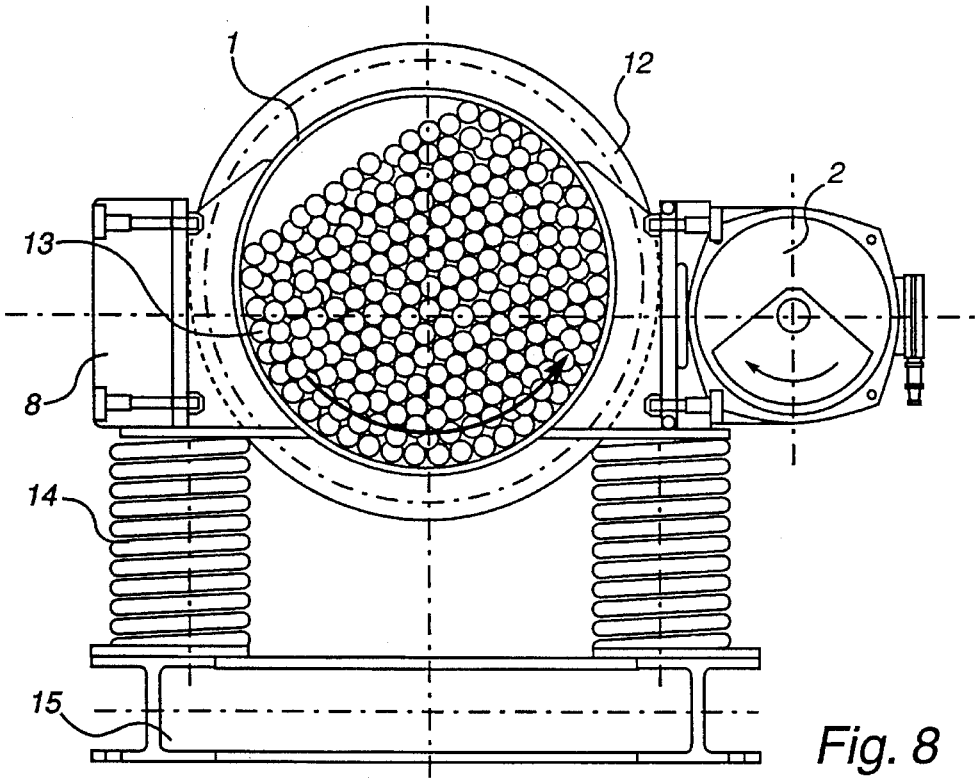
FIG. 8 shows a side view along line A–B in FIG. 7.

With the eccentric vibrating mill illustrated in FIGS. 7 and 8 a grinding container in the form of a grinding tube (1) is supported for oscillating on a basic frame (15) by means of vibrating support elements (14). An exciter unit in the form of an eccentric motor (2) is solidly attached to grinding tube (1) on the right by means of a transverse member (12), whereby the spring axis of vibrating support element (14) on the drive side lies between the gravity axes of grinding container (1) on one side and exciter unit (2) on the other side.

Solidly attached also to transverse member (12) is balancing mass (8) lying opposite and parallel to eccentric motor (2). Located inside grinding tube (1) are standard grinding elements (13); the movement directions are shown as clockwise motion. FIG. 7 illustrates front wall (17) of the grinding container as well as grinding material inlet (18) and grinding material outlet (19).

Figure 9:
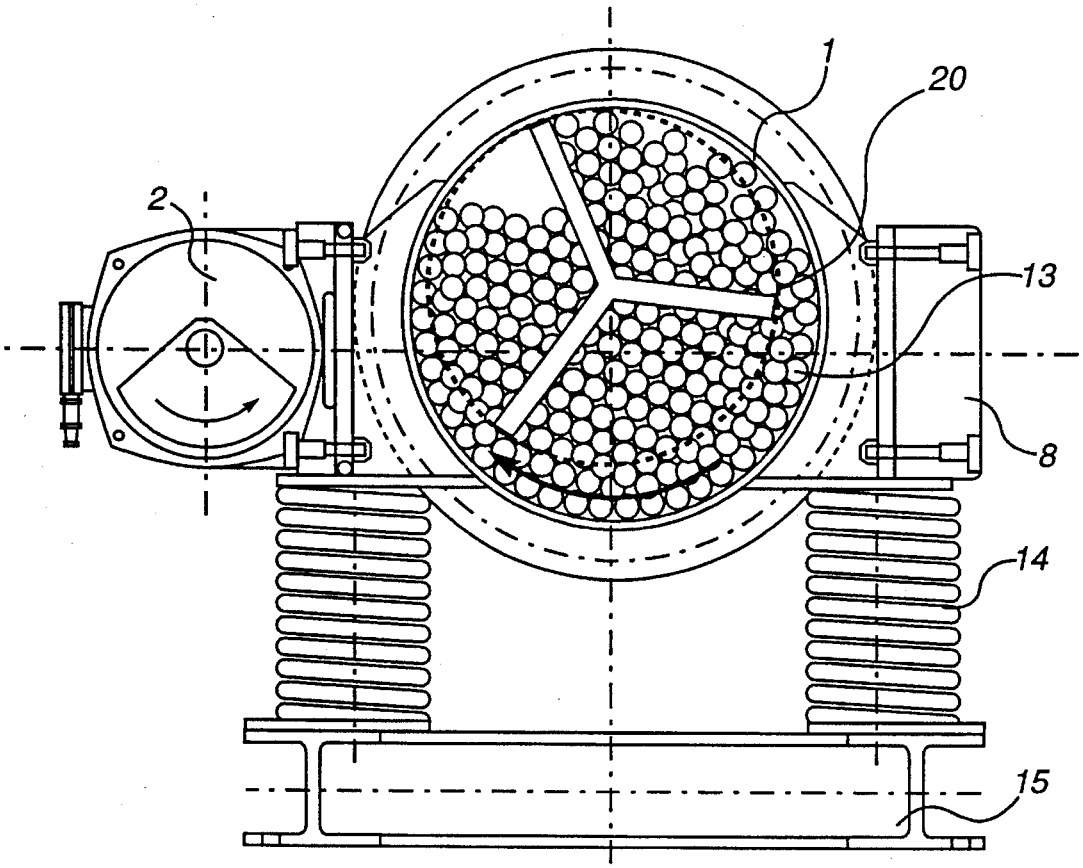
FIG. 9 shows, essentially according to FIG. 6, a sectional view with a chamber wheel arranged in the grinding container of the vibrating mill.

The design shown in FIG. 9 of the vibrating mill according to the present invention has an additional so-called chamber wheel (20) allowing the vibrating mill to operate according to the so-called rotating chamber principle. In this case exciter (2) is located to the left; the directions of movement are shown as anticlockwise motion.

We claim:

1. A vibrating mill comprising:

at least one grinding container having:

a vertically oriented gravity axis defined therethrough; and a mass center;

at least one exciter unit being operatively connected to said at least one grinding unit to impart at least one vibratory movement to said at least one grinding container solely at a portion of said at least one grinding container that is offset from said gravity axis and said mass center and solely at one side of said gravity axis;

a balancing mass operatively connected to said at least one grinding container at a portion of said at least one grinding container that is disposed at an opposite side of said gravity axis from said portion of said at least one grinding container that is offset from said gravity axis and said mass center;

whereby said at least one grinding container is excited eccentrically at said portion offset from said gravity axis and said mass center by said at least one exciter unit such that, combined with the influence of said balancing mass, at least one uneven vibration is produced.

2. The vibrating mill of claim 1, further comprising:

means for supporting said at least one grinding unit and reflecting the at least one vibratory movement imparted to said at least one grinding unit by said at least one exciter unit;

said supporting means comprising at least one drive-side support element being connected to said at least one grinding unit at a portion of said at least one grinding unit that is disposed between said gravity axis and said at least one exciter unit;

said at least one drive-side support element comprising means for providing a compensatory vibratory movement, in response to the at least one vibratory movement imparted to said at least one grinding unit by said at least one exciter unit, along at least one axis;

wherein said portion of said at least one grinding unit offset from said gravity axis and said mass center is also offset from said at least one axis of said at least one drive-side spring element.

3. The vibrating mill of claim 2, wherein said balancing mass comprises a member being discrete and separate with respect to said at least one exciter unit.

4. The vibrating mill of claim 3, wherein said balancing mass is connected to said at least one grinding container at a portion of said at least one grinding container that is, with respect to said at least one grinding container, substantially diametrically opposite from said at least one exciter unit.

5. The vibrating mill of claim 4 wherein the at least one uneven vibration comprises one or more vibrations selected from the group consisting essentially of circular, elliptical and linear vibrations.

6. The vibrating mill of claim 5, further comprising a chamber wheel disposed within said at least one grinding container.

7. The vibrating mill of claim 4 wherein:

said exciter unit further includes an axis disposed substantially parallel to the gravity axis of said at least one grinding container, and further wherein said at least one grinding container comprises an inner wall and a center; and the distance from the axis of said exciter unit to the gravity axis of said at least one grinding container is greater than the smallest distance from the center of the at least one grinding container to the inner wall of said at least one grinding container.

8. The vibrating mill of claim 4, further comprising a second exciter unit operatively connected to said at least one grinding container.

9. The vibrating mill of claim 4 wherein said at least one grinding container is excited by several exciter units lying along an axis substantially parallel to the gravity axis of said at least one grinding container.

10. The vibrating mill of claim 9 wherein the several exciter units are synchronized.

11. The vibrating mill of claim 9 wherein the several exciter units are arranged substantially above one another and substantially parallel to the gravity axis of said at least one grinding container.

12. The vibrating mill of claim 4 wherein said at least one exciter unit comprises an eccentric motor.

13. The vibrating mill of claim 4 wherein said at least one grinding container comprises a plurality of grinding containers and said at least one exciter unit comprises a plurality of exciter units, said grinding containers and exciter units being respectively paired to form a plurality of grinding container/exciter unit modules.

14. The vibrating mill of claim 4 wherein said at least one grinding container is arranged substantially parallel to an axis of the vibrating mill.

15. The vibrating mill of claim 4 wherein said at least one grinding container comprises a grinding tube.

16. The vibrating mill of claim 4 wherein said at least one uneven vibration comprises a circular vibration, an elliptical vibration and a linear vibration provided simultaneously at different respective portions of said at least one grinding container.

17. The vibrating mill of claim 16, wherein:

the circular vibration is provided in the vicinity of said portion of said at least one grinding container at which the at least one vibratory movement is imparted by said at least one exciter unit;

the elliptical vibration is provided in the vicinity of the mass center of said grinding unit; and the linear vibration is provided in the vicinity of said balancing mass.

18. A vibrating mill comprising:

at least one grinding container having a gravity axis, a first side and a second side, wherein said first and second sides lie on opposite sides of said gravity axis;

at least one exciter unit being operatively connected to the first side of said at least one grinding container to impart at least one vibratory movement to said at least one grinding container at said first side of said at least one grinding container, said exciter unit having an exciter mass, said exciter mass having a gravity axis; and a first spring supporting said at least one grinding container at the first side thereof and for providing a compensatory vibratory movement, in response to the at least one vibratory movement imparted to said at least one grinding container by said at least one exciter unit, along a spring axis, the spring axis being disposed between the gravity axes of said at least one grinding container and said exciter mass.

19. The vibrating mill of claim 18, further comprising a balancing mass operatively connected to the second side of said at least one grinding container.

* * * * *